United States Patent [19]

Hardwick et al.

[11] 4,334,650

[45] Jun. 15, 1982

[54] SHREDDING MACHINES

[76] Inventors: John P. Hardwick, 50 Aldelaide St., Crewe, Cheshire CW1 3DT; Michael J. Pezet, 17 Woodside Grange, Quorn, Leicestershire, both of England; Asadollah A. Sarvestany, S. Danshgah Ave., Mestah Alley No. 28, Tehran, Iran; Dayananda Satharasinghe, 204J Block B, Clementi Rd., Singapore, Singapore, 5

[21] Appl. No.: 190,881

[22] PCT Filed: Jul. 4, 1979

[86] PCT No.: PCT/GB79/00110

§ 371 Date: Mar. 5, 1980

§ 102(e) Date: Mar. 4, 1980

[87] PCT Pub. No.: WO80/00129

PCT Pub. Date: Feb. 7, 1980

[30] Foreign Application Priority Data

Jul. 5, 1978 [GB] United Kingdom ..... 28953/78

[51] Int. Cl.[3] ..... B02C 18/18

[52] U.S. Cl. ..... 241/236; 241/238; 241/294

[58] Field of Search ..... 241/235, 236, 294, 295, 241/230, 238, 234

[56] References Cited

U.S. PATENT DOCUMENTS 1,249,020 12/1917 Bullock ..... 241/238 X
1,798,000 3/1931 Schultz ..... 241/235
1,884,316 10/1932 Smith ..... 241/294

FOREIGN PATENT DOCUMENTS 1310057 3/1973 United Kingdom .
1315347 5/1973 United Kingdom .
1454288 11/1976 United Kingdom .
1491611 11/1977 United Kingdom .
1589214 5/1981 United Kingdom .

*Primary Examiner*—Mark Rosenbaum
*Attorney, Agent, or Firm*—Diller, Ramik & Wight

[57] ABSTRACT

A cutter for a rotary shredding machine which includes a disc-like body defining a coaxial shaft aperture therethrough adapted to accommodate a rotary shaft which defines a cutting axis, the body including a plurality of cutter body members and releasable fastening means for holding the body members together with at least one of the body members having a radially projecting tooth including a cutting edge along a leading edge thereof, each cutter body member having two first surface portions extending chordally from the body periphery and joined by a second surface portion adapted for engaging a shaft, the second surface portions together defining the shaft aperture, and each first surface being juxtaposed with, but spaced from, a parallel, corresponding first surface portion of the next adjacent body member thereby to permit limited tilting movement of the toothed body member circumferentially about the cutter axis with simultaneous momentary deformation of that body member when a sufficiently high impact force is applied to this tooth, the fastening means being constructed and arranged to permit such tilting.

9 Claims, 6 Drawing Figures

FIG. 3
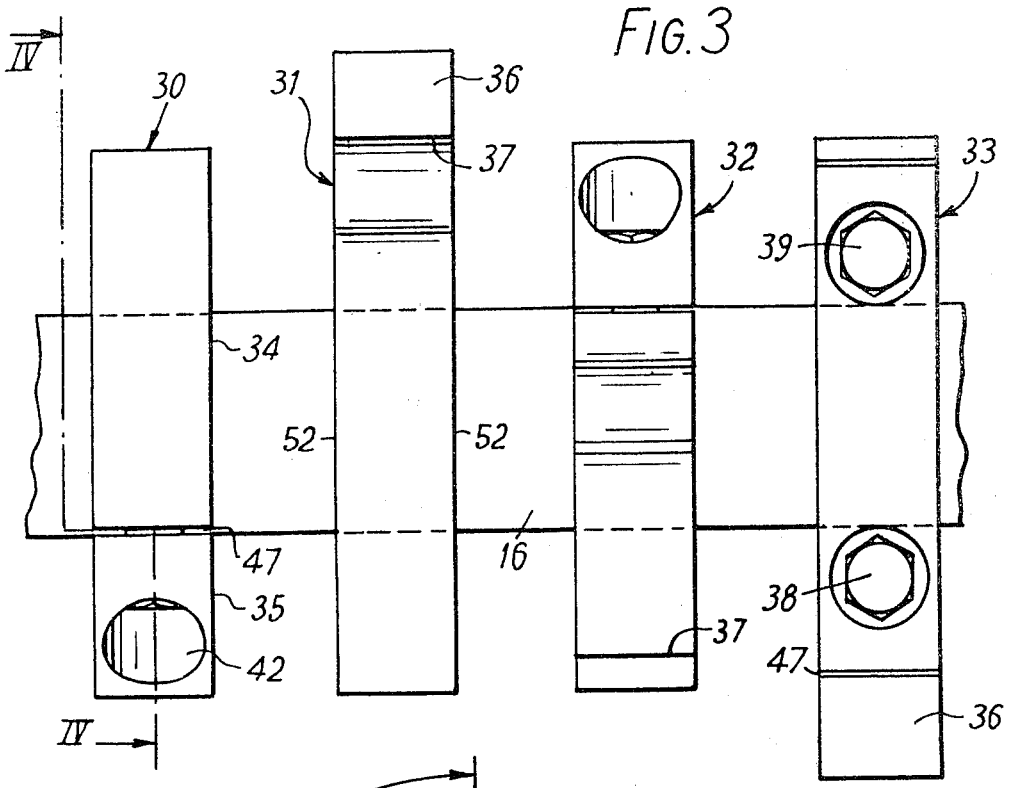
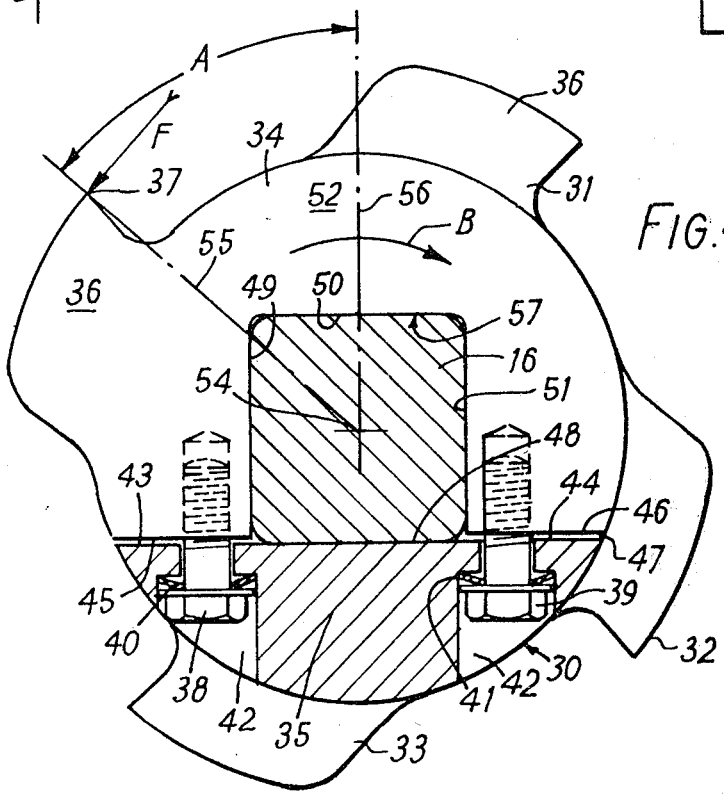
FIG. 4

SHREDDING MACHINES

This invention relates to cutters for a rotary shredding machine, and to rotary shredding machines of the kind (hereinafter referred to as a "machine of the kind hereinbefore specified") having a comminuting chamber, a pair of parallel cutter shafts arranged for simultaneous contra-rotation in the comminuting chamber, and a plurality of said cutters carried by the shafts, at least one of the shafts having more than one said cutter secured thereon and the cutters of one shaft being interleaved with the cutter or cutters of the other, so as to co-operate in comminuting material fed into the chamber. The cutters to which the invention relates are of the kind comprising a generally disc-like body having at least one radially-projecting peripheral tooth provided with a cutting edge along a leading edge thereof, and the body defining a coaxial shaft aperture therethrough to accommodate a said shaft and defining a cutter axis. Such a cutter will be called a "cutter of the kind hereinbefore specified".

Although machines of the above kind are normally referred to as shredding machines or shredders, their comminuting action takes a form or forms which depend largely on the nature of the material being comminuted, and on the design of the cutters. The latter may in practice perform very little cutting as such; for example, glass will tend to be crushed into small pieces, whilst other common materials, such as thin metal, will tend to be torn and/or deformed by crushing. The material to be comminuted is most usually scrap or waste material, though shredders can be used to break up solid materials as part of, or in preparation for, industrial processes of various kinds.

Various types of shredding machine of the kind hereinbefore specified are in commercial use or have been proposed. British patent specification No. 1,315,347, for example, describes various forms of such a machine in all of which the single tooth of each cutter has a pronounced rake of at least 45° and is undercut to give a cutting angle of not less than 45°, so that the tooth has a leading point at one end of its cutting edge whereby it performs a piercing action and then a cutting action. British patent specification No. 1,310,057 describes a shredding machine of the same general kind, but with cutters each of which co-operates with one cutter on the other shaft to comminute the material by at least partly working it between the single side face of one cutter of this pair and the single side face of the other, these faces being in a continuously overlapping relationship in the region in which comminution takes place. Our British patent specification No. 1,454,288 describes yet another machine characterised partly by the fact that each cutter has two profiled cutting edges extending around nearly the whole periphery of the cutter, one at each end of the cutter.

British patent specification No. 1,491,611 describes a shredder cutter which consists of several identical segments, rigidly bolted together to clamp them on to a cylindrical shaft to which the cutter segments are splined. The provision of a split or multi-segment cutter, which can be disassembled and then removed in a radial direction from the shaft, obviates a disadvantage of the one-piece cutters described in the other above-mentioned specifications, viz. that the cutters have to be threaded on and off the shaft, thus entailing the major operation of exposing one end of the shaft and then removing the cutters and other components (if any) between that end and the affected cutter.

In all of the above-mentioned specifications, the cutter is rigidly secured on the shaft. Indeed, it has hitherto been thought that it was always desirable to secure it as firmly as possible so that shaft and cutters behave at all times as a rigid unit, the cutting edge or edges being rigidly orientated with respect to the shaft. Thus, when the machine is subjected to so-called "crash-stop" conditions, e.g. when so-called tramp material in the form of an intractable object is encountered by the cutters which cannot comminute the tramp material, the forces resulting from the impact between a cutter tooth and tramp material are transmitted back through the shafts to the gearbox and/or other drive means of the machine. The specification of our co-pending British patent application No. 34262/76 describes shredding machines within the aforementioned definition of kind, in which an automatically disengageable clutch is interposed in the drive mechanism between the high-speed, high-inertia part of the latter (such as the rotor of a drive motor) and the low-speed part such as the gearbox that transmits the drive from the motor to the cutter shafts. The same specification teaches how those working components of the machine directly or indirectly controlled by the clutch can then be so constructed that they will not fail under their own or each other's inertia effects under crash-stop conditions.

According to the present invention, in a first aspect, in a cutter of the kind hereinbefore specified, the cutter body comprises a plurality of cutter body members and releasable fastening means holding the body members together, at least one of said body members having a said tooth, each body member having two first surface portions extending chordally from the body periphery and joined by a second surface portion for engaging a said shaft, the said second surface portions together defining the shaft aperture, and each said first surface portion being juxtaposed with, but spaced from, a parallel, corresponding said first surface portion of the next adjacent body member, whereby to permit limited tilting movement of a said toothed body member about the cutter axis, with simultaneous momentary deformation of that body member, when a sufficiently high impact force is applied to its tooth, the said fastening means being adapted to permit such tilting.

The degree of deformation that takes place varies with the force applied, but the yielding of part of the cutter, which consists partly in its tilting and partly in the said deformation, is accomplished in a matter of a few microseconds and, in this space of time, absorbs at least part of the strain energy resulting from the impact. The fastening means, furthermore, preferably include resilient mounting means biassing the body members towards their untilted positions relative to each other. This resilient device acts as a further shock absorber to cushion still more of the impact energy and, again, does so in the same short space of time. Since the affected tooth is able to yield upon impact, the danger of tooth damage is reduced.

Cutters according to the invention are preferably employed in a machine having a disengageable clutch or other suitable torque limiting device, arranged to operate rapidly as soon as crash-stop conditions are encountered. However, since the reaction time of such devices will not normally be nearly as short as that of the yielding cutter, some of the impact forces will normally be transmitted to the cutter shafts and thence to the drive mechanism and other components such as shaft bearings. The yielding cutter reduces the magnitude of these transmitted forces, thus enabling lighter and/or less expensive components to be incorporated in the machine. The machine is preferably of the general kind discussed in our aforementioned specification No. 34262/76.

Preferably the cutting edge of the or each cutting tooth is substantially parallel to the cutter axis, i.e. the tooth has substantially no rake and is not a piercing and cutting tooth in the sense discussed above.

The second surface portion of each cutter body member preferably comprises at least one substantially flat, chordal, such that the shaft aperture defined by these chordal faces is polygonal. It is preferred that the shaft aperture be substantially square, to fit a cutter shaft of substantially square cross-section.

According to the invention in a second aspect, there is provided a machine of the kind hereinbefore specified whereof each cutter is a cutter according to the invention in its first aspect.

Embodiments of the invention will now be described, by way of example only, with reference to the drawings hereof, in which:

FIG. 3 is a plan view of part of a cutter shaft carrying cutters, according to the invention;

FIG. 4 is a sectional view taken on the line IV—IV in FIG. 3;

Figure 1:
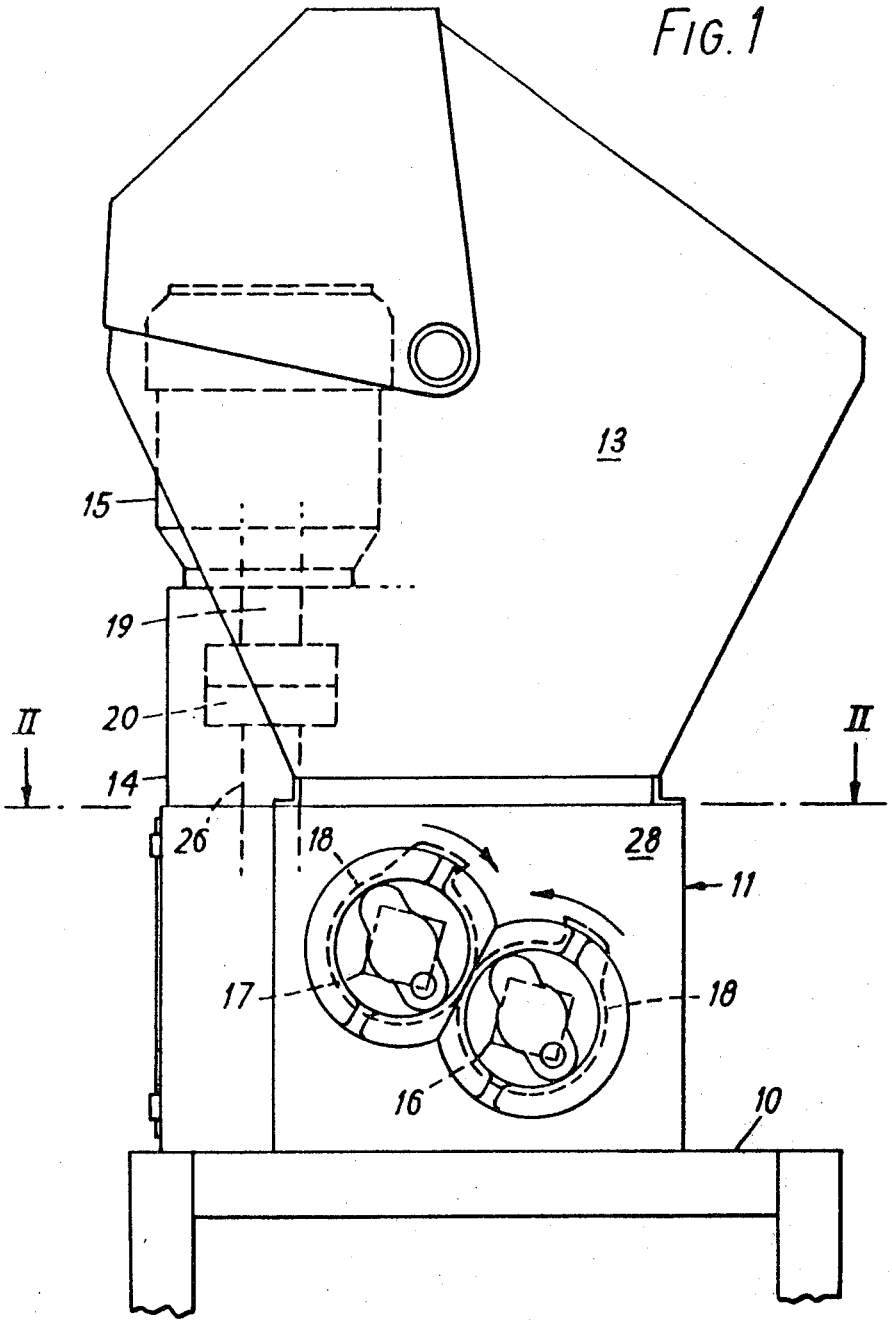
FIG. 1 is a simplified side elevation, as seen from the bottom end of FIG. 2, of a rotary shredding machine.
Figure 2:
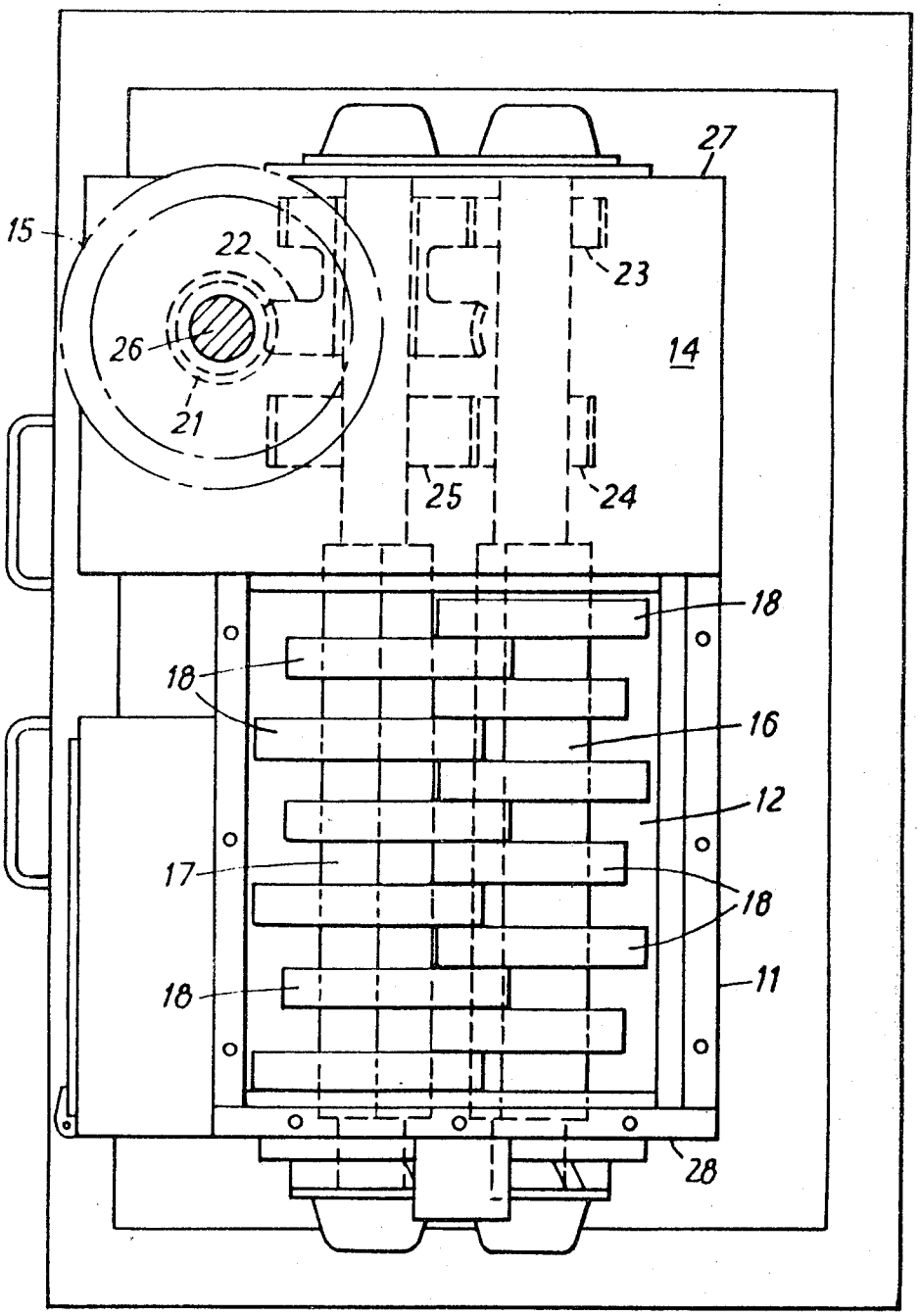
FIG. 2 is a plan view taken on the line II—II in FIG. 1.

The shredding machine (shredder) shown in FIGS. 1 and 2 has a base frame 10 on which are mounted a cutter box 11 and a gearbox 14. The cutter box 11 encloses a rectangular comminuting chamber 12 which is open at top and bottom. A loading hopper 13 is fixed on top of the cutter box 11. Extending through the chamber 12 and gearbox 14 are a pair of parallel cutter shafts 16,17. A motor 15, mounted on the gearbox 14, has a shaft 19 driving a clutch 20, whose driven shaft 26 carries a worm 21 which drives a worm wheel 22 carried on, but rotatable independently of, the cutter shaft 17. The wheel 22 drives the cutter shaft 16 through a pinion 23 on the latter, whilst the cutter shaft 17 is driven by a pinion 24 on the shaft 16 through a gear 25 on the shaft 17 so that the latter is rotated in the opposite direction to the shaft 16, as indicated by the arrows in FIG. 1, and at a slower speed.

The shredder is preferably constructed according to the principles described in our co-pending British patent application No. 34262/76 aforementioned.

Each of the cutter shafts 16,17 is mounted in end bearings in the opposite end walls 27,28 and also a bearing in a centre plate (not shown), of the gearbox and cutter box respectively, and that part of each cutter shaft that extends through the cutter box is of square cross-section as indicated in FIG. 1. Each shaft 16,17 carries six cutters 18 which are secured on the shafts, each cutter being spaced by an equal amount from the next such that the cutters of the shaft 16 are interleaved with those of the contra-rotating shaft 17, so as to cooperate with them in comminuting material fed from the hopper 13 into the chamber 12.

Each of the cutters 18 comprises a generally disc-like body having at least one radially-projecting peripheral tooth provided with a cutting edge. Each cutter body, furthermore, comprises two body members each having two first surface portions extending chordally from the body periphery and joined by a second surface portion which engages the cutter shaft, so that these second surface portions together constitute the sides of a square, coaxial through aperture in which the respective cutter shaft is accommodated. This aperture defines the cutter axis which is coincident with the axis of the corresponding shaft 16 or 17. Each of the chordal first surface portions of one of the body members is juxtaposed with, but spaced from, a parallel, corresponding one of the chordal first surfaces of the other body member, and the two body members are held together and clamped on the shaft by releasable fastening means. An embodiment of such a cutter which may advantageously be incorporated in the shredder of FIGS. 1 and 2 will now be described.

Referring therefore to FIGS. 3 and 4, four identical cutters 30,31,32,33 are in this example mounted on part of the square-section cutter shaft 16. The body of each cutter 30 to 33 comprises a first and larger body member 34 and a second and smaller segmental body member 35. The member 35 has a chordal plane surface whose first or outer portions 43,44, extending from the cylindrical peripheral surface 53 of the cutter body, are joined by the shaft engaging surface portion or face 48. The outer surface portions 43 and 44 are juxtaposed with plane surface 45 and 46 respectively of the member 34, with which they are parallel but from which they are spaced by a narrow gap 47. The sides of the square shaft aperture, the centre of which is the cutter and shaft axis 54, consist of the face 48 and three chordal faces 49,50,51 joining the surfaces 45 and 46 of the larger member 34.

The releasable fastening means comprises a pair of elongate fasteners in the form of a stud 38 and a stud 39, both fixed in the body member 34 and extending through, respectively, the pair of surfaces 43,45 and the pair of surfaces 44,46. The head of each stud lies in a respective recess 42 in the outer peripheral surface of the segmental member 35, and bears on the bottom of the recess through a Belleville washer 40,41. The larger body member 34 is thus mounted, through the studs and the Belleville washers, resiliently upon the segmental member 35; the two members 34 and 35 together constitute a disc-like body having opposed, parallel, flat side faces 52.

The cutter can be removed from the shaft 16 by removing the studs 38 and 39 and drawing the two body members 34 and 35 radially outwards.

Each of the larger body members 36 has a single integral, radially-projecting tooth 36 whose cutting edge 37, at the leading end of the tooth in the direction of normal rotation of the cutter (indicated by the arrow B in FIG. 4) is parallel with the axis 54, and lies in a radial plane 55 which is displaced, rearwardly with respect to the direction B, by an angle A from the diametral plane 56 which bisects the shaft 16 and the face 48 of the segmental member. The angle A is in the range 0° to 60°, but in this example it is 50°.

In operation, the cutters are rotated as indicated in FIG. 1 and matter to be comminuted is fed down on to them from the hopper 13, to be broken up by the cutters in known manner and discharged through the open bottom of the chamber 12. If an object of tramp material (e.g. an iron bar or other object which the cutters cannot break up) is introduced, the drive mechanism is reversed several times and, if the object is still there, the machine is then stopped. This is achieved automatically by a suitable control system not shown.

Impact of the cutting edge 37 of a cutter upon an object produces a force on the edge 37 having a tangential component F (FIG. 4). During normal operation such a force exists as the cutting edge comes into contact with material to be comminuted, but the cutter continues to rotate with the cutter body members clamped together in the relative disposition shown in FIG. 4. If, however, due for example to impact of the cutting edge 37 upon an object of tramp material, the force F is greater than a value which can be predetermined by providing a suitable stiffness of the Belleville washers 40,41, this force exerts a rearward turning movement upon the body member 34 which overcomes the stiffness of the washer 41 and causes the member 34 to undergo a limited tilting movement with respect to the segmental member 35. This tilting, which takes place in a matter of a few microseconds, is shown (somewhat exaggerated) in FIG. 5. The washer 40 is such that it continues to exert a force between the head of the stud 38 and the bottom of the corresponding recess 42.

Figure 5:
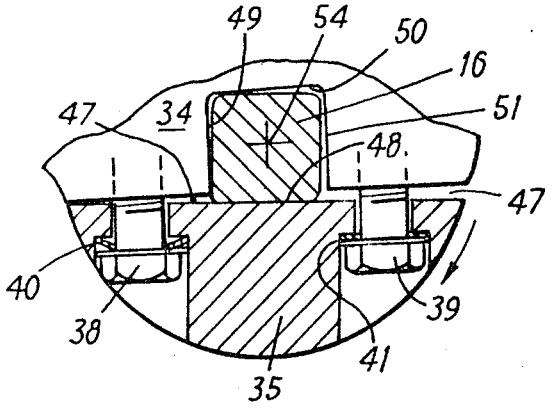
FIG. 5 is a scrap sectional view similar to FIG. 4 but showing an effect of an impact force on a cutter.

It will be realised that the shaft aperture 57 (defined by the faces 48 to 51) in the cutter is a close sliding fit on the shaft 16, though not an interference fit. The tilting action of the cutter body member 34 is thus accompanied by some simultaneous elastic deformation of the latter in the vicinity of the faces 49 to 51, so that much of the energy imparted by the force F under crash-stop conditions is dissipated as strain energy due to this momentary deformation. In FIG. 5 the faces 49 to 51 are shown diagrammatically, their deformation not being illustrated. As soon as the rotation of the shaft 16 is reversed and/or the force F is otherwise removed, e.g. by removal of the tramp material, the body member 34 is restored automatically to its normal position relative to the member 35 as shown in FIG. 4.

Figure 6:
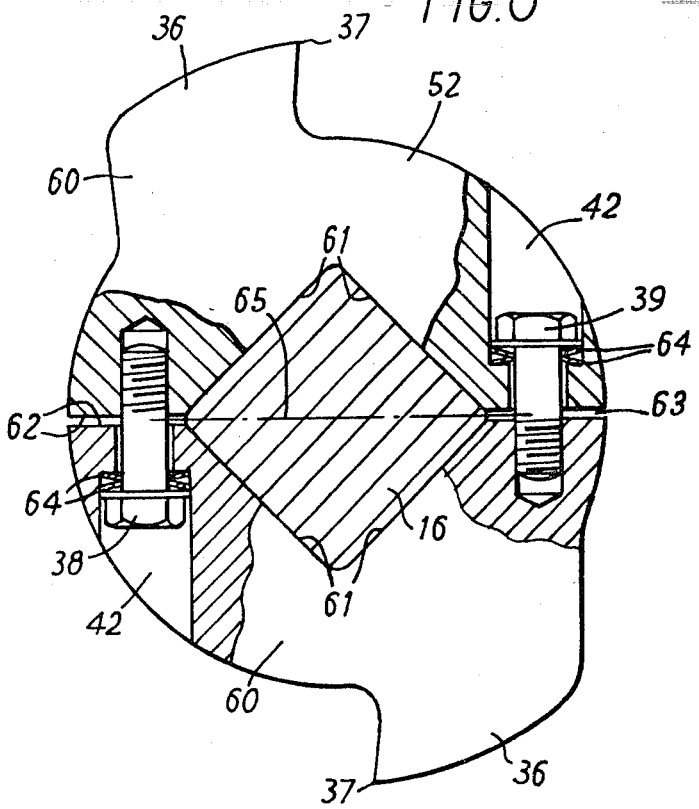
FIG. 6 is an axial elevation of a cutter in one possible modified form.

Referring now to FIG. 6, this shows one of a number of variations which are possible in the construction of a cutter according to the invention. The cutter in FIG. 6 is a double-toothed cutter having one tooth 36 formed in each of its two identical body members 60. The members 60 are again arranged to be clamped, by studs 38,39 resiliently mounted by Belleville washers in recesses 42 in the body members, around the square shaft 16, and for this purpose each body member in this particular embodiment has two shaft-engaging faces 61 at right angles to each other and at 45° to the pairs of chordal surfaces, 62, which in this case define opposed diametral gaps 63 between them to allow for tilting of either one of the members 60 relative to the other under crash stop conditions. The shank of the stud 38 is in this embodiment secured in one of the members 60 and that of the stud 39 is secured in the other.

FIG. 6 shows each fastening stud 38,39 mounted by a pair of Belleville washers 64 instead of a single washer as in FIGS. 4 and 5. It will be realised that in either embodiment, or indeed in any other embodiment of cutter according to the invention having resilient mounting means in the form of Belleville washers, the latter may be provided singly or in groups of two or more. Furthermore, in the latter case they may be arranged back-to-back as in FIG. 6, i.e. in series, or in nesting relationship, i.e. in parallel.

Although FIG. 6 shows the shaft 16 orientated with a diagonal plane coincident with the diametral plane, 65, defined by the gap 63 between the two cutter body members 60, each of the latter may be formed with a rectangular recess such that the two rectangular recesses together form a square shaft aperture in which the diametral plane 65 bisecting the shaft in parallel with two sides of the shaft.

Furthermore, it is not essential that the two chordal surfaces of each cutter body member associated with the fastening means (e.g. the surfaces 43,44; 45,46; or 62) lie in a common plane. Thus, for example in FIG. 4, the member 35 could be made with a second shaft-engaging face perpendicular to the face 48 and engaging the side of the shaft which in FIG. 4 is engaged by the face 51 of the member 34. The face 44 would then be continuous with this second shaft-engaging face, with the member 34 modified accordingly. Such an arrangement may be convenient irrespective of the number of teeth 36 per cutter, but may be especially useful if it is desired to provide an odd number of teeth, for example three.

The fastening means of the cutter need not consist of studs, though threaded studs as shown, or bolts with separate nuts, are a convenient form of fastening. Preferably the fastenings will be provided with a suitable locking device, in any known form, for resisting rotation of the stud, bolt or nut during operation of the machine due to vibration or other similar causes.

It will also be appreciated that the Belleville washers, instead of being interposed under the heads of the studs 38,39, could be mounted in recesses in the faces 43,44 to bear directly on the faces 45,46 respectively. Furthermore, coil springs may be employed instead of Belleville washers.

It will be understood that in cutters according to the invention, the cutting teeth may be separate members attached by suitable means to the body members.

The machine itself may or may not have a clutch. The cutter shafts may or may not be arranged for rotation at different speeds; the cutter shafts may have their axes in a common horizontal plane; there may be any desired number of cutters on each shaft; and any suitable arrangement for delivering material to the cutters for comminution, and for collecting it after comminution, may be provided.

In FIGS. 3 and 4 each cutter is shown displaced by 90° with respect to the next one on the same shaft, so that the cutting edges 37 define a helix. It will be understood however that any relative orientation, i.e. angular displacement, of the cutters, may be chosen according to the particular application of the machine, subject to the condition being met, in the case of cutters having a square shaft aperture, that the cutting edge of each tooth is intersected by a radial plane inclined at an angle of 0° to 60°, to a diametral plane bisecting one side of the square shaft aperture, the angle being defined forward of the cutting edge in the direction of intended rotation of the cutter. It will be observed, by way of illustration, that this condition is in fact met in FIG. 4, in which the angle A of 50° is defined forward of the edge 37. Again, provided that, where the shaft aperture is square, this condition is met, the cutter may be provided with any number of teeth consistent with there being enough space around the circumference to accommodate them.

Each cutter may comprise more than two body members, particularly for use in very large machines where a large cutter may be called for. The construction of such a cutter may for example be a straightforward adaptation of that shown in FIG. 6, but with one tooth on each body member and with the two surfaces 62 of each body member lying in radial planes subtending an angle which depends on the number of body members. Here again the abovementioned condition must be satisfied if the shaft aperture is square.

It will also be understood that, whilst the provision of resilient mounting means (such as the Belleville washer) between adjacent cutter body members is highly advantageous, if they are omitted tilting and elastic deformation of one body element relative to another, under crash-stop or other exceptional impact conditions can still take place with consequent rapid absorption of part of the energy released by the impact.

Although use of a square-section cutter shaft is preferred, the shaft may in practice be of any cross-section, e.g. cylindrical or hexagonal. Cutters according to the invention may thus be provided as replacements for the one-piece cutters of existing machines of conventional design. In the case of any shaft cross-section, it will be necessary (if both parts of the cutter are to be made removable) to provide each gap such as 47 or 63 between the two parts of the cutter in such a position relative to the shaft that the greatest cross-sectional dimension of the shaft, in the direction of a plane joining the ends of the two gaps across the shaft aperture, is no greater than the distance between those ends. If the shaft is cylindrical, a suitable positive keying arrangement must be provided between the shaft and at least one of the cutter members.

We claim:

1. A cutter for a rotary shredding machine comprising a generally disc-like body, the body defining a coaxial shaft aperture therethrough adapted to accommmodate a shaft and defining a cutting axis, said body including a plurality of cutter body members and releasable fastening means for holding the body members together, at least one of said body members having at least one radially projecting peripheral tooth having a cutting edge along a leading edge thereof, each cutter body member having two first surface portions extending chordally from the body periphery and joined by a second surface portion adapted for engaging a shaft, said second surface portions together defining the shaft aperture, and each said first surface portion being juxtaposed with, but spaced from, a parallel, corresponding said first surface portion of the next adjacent body member thereby to permit limited tilting movement of said toothed body member circumferentially about the cutter axis with simultaneous momentary deformation of that body member when a sufficiently high impact force is applied to this tooth, the said fastening means being constructed and arranged to permit such circumferential tilting.

2. A cutter according to claim 1, characterised in that the fastening means include resilient mounting means biassing the body members towards their untilted positions relative to each other.

3. A cutter according to claim 2, characterised in that the fastening means comprise a plurality of elongate fasteners, each being fixed to one of the two body members which it holds together and extending through a pair of the juxtaposed first surface portions of those body members, the mounting means comprising a resilient element mounting each fastener on the other body member.

4. A cutter according to any one of the preceding claims, characterised in that the second surface portion of each cutter body member comprises at least one substantially flat, chordal face, these chordal faces of the cutter body members together defining a polygonal said shaft aperture.

5. A cutter according to any one of claims 1 to 3, characterised by two said body members.

6. A cutter according to any one of claims 1 to 3, characterised in that the cutting edge of the or each cutting tooth is substantially parallel to the cutter axis.

7. A rotary shredding machine comprising a comminuting chamber, a pair of parallel cutter shafts arranged for simultaneous contra-rotation in the comminuting chamber, a plurality of cutters carried by the shaft, at least one of the shafts having more than one cutter secured thereon and the cutters of one shaft being interleaved with the cutters of the other shafts so as to cooperate in comminuting material fed into the chamber, each said cutter including a generally disc-like body defining a coaxial shaft aperture therethrough receiving an associated one of said shafts and defining therewith a cutting axis, each said body including a plurality of cutter body members and releasable fastening means for holding the body members together, at least one of said body members having at least one radially projecting peripheral tooth having a cutting edge along a leading edge thereof, each cutter body member having two first surface portions extending chordally from the body periphery and joined by a second surface portion engaging an associated one of said shafts, said second surface portions together defining the associated shaft aperture, each said first surface portion being juxtaposed with, but spaced from, a parallel, corresponding first surface portion of the next adjacent body member thereby to permit limited tilting movement of said tooth body members circumferentially about the cutter axis of an associated shaft with simultaneous momentary deformations of that body member when a sufficiently high impact force is applied to this tooth, and said fastening means being constructed and arranged for such circumferential tilting.

8. The rotary shredding machine as defined in claim 7 wherein said fastening means include resilient mounting means biasing the body members toward their untilted positions relative to each other.

9. The rotary shredding machine as defined in claim 8 wherein said fastening means comprise a plurality of elongated fasteners, each being fixed to one of the two body members which it holds together and extending through a pair of the juxtaposed first surface portions of those body members, and the mounting means comprising a resilient element mounting each fastener on the other body member.

* * * * *